US009194145B2

(12) United States Patent
Staten et al.

(10) Patent No.: US 9,194,145 B2
(45) **Date of Patent: *Nov. 24, 2015**

(54) POWERED TELESCOPIC SEATING RISER ASSEMBLY

(75) Inventors: Kenneth Edward Staten, Clare, MI (US); Orley David Rogers, Sanford, MI (US)

(73) Assignee: Stageright Corporation, Clare, MI (US)

( * ) Notice: Subject to any disclaimer, the term of this patent is extended or adjusted under 35 U.S.C. 154(b) by 782 days.

This patent is subject to a terminal disclaimer.

(21) Appl. No.: 13/010,067

(22) Filed: Jan. 20, 2011

(65) Prior Publication Data

US 2011/0107682 A1 May 12, 2011

Related U.S. Application Data

(63) Continuation of application No. 11/542,753, filed on Oct. 4, 2006, now Pat. No. 7,900,402.

(51) Int. Cl.
*E04H 3/12* (2006.01)
*E04B 1/38* (2006.01)

(52) U.S. Cl.
CPC *E04H 3/123* (2013.01); *E04B 1/38* (2013.01); *E04H 3/126* (2013.01)

(58) Field of Classification Search
CPC ..... E04H 3/123; E04H 3/126; E04B 1/38
USPC ..... 52/6, 8, 9, 10; 472/59, 60, 130; 434/29, 434/55
See application file for complete search history.

(56) References Cited

U.S. PATENT DOCUMENTS

| | | | | | |
|---|---|---|---|---|---|
| 2,898,639 | A | * | 8/1959 | Murphy | 52/10 |
| 2,968,842 | A | * | 1/1961 | Murphy | 52/10 |
| 2,990,587 | A | * | 7/1961 | Murphy | 52/10 |
| 3,069,732 | A | * | 12/1962 | Murphy | 52/10 |
| 3,083,582 | A | * | 4/1963 | Wheeler | 474/139 |
| 3,107,398 | A | * | 10/1963 | Murphy | 52/10 |
| 3,213,570 | A | * | 10/1965 | Abramson, Jr. | 52/8 |
| 3,488,898 | A | * | 1/1970 | Scaggs | 52/10 |
| 3,748,798 | A | * | 7/1973 | Mackintosh | 52/10 |
| 3,781,738 | A | * | 12/1973 | Rozelle | 336/15 |
| 3,799,824 | A | * | 3/1974 | Arnao et al. | 156/139 |
| 4,000,586 | A | * | 1/1977 | Vance et al. | 52/9 |
| 4,285,172 | A | * | 8/1981 | Quigley | 52/10 |
| 4,343,846 | A | * | 8/1982 | Kohn | 428/138 |
| 4,979,340 | A | * | 12/1990 | Wilson et al. | 52/9 |
| 5,069,007 | A | * | 12/1991 | Paddock | 52/9 |
| 5,205,087 | A | * | 4/1993 | Jines | 52/6 |
| 5,381,873 | A | | 1/1995 | Kniefel et al. | |
| 5,467,840 | A | * | 11/1995 | Becher et al. | 180/251 |
| 5,559,411 | A | * | 9/1996 | Winship | 318/466 |
| 5,673,518 | A | * | 10/1997 | Paddock | 52/9 |
| 5,692,445 | A | | 12/1997 | Winer | |
| 5,796,052 | A | * | 8/1998 | Christmann | 177/145 |
| 5,913,776 | A | * | 6/1999 | Compagnone | 52/10 |
| 6,029,406 | A | * | 2/2000 | Staehlin | 52/9 |

(Continued)

*Primary Examiner* — Brian Glessner
*Assistant Examiner* — Joshua Ihezie
(74) *Attorney, Agent, or Firm* — Carlson, Gaskey & Olds, P.C.

(57) ABSTRACT

A non-permanent seating system includes a first and second riser assembly each having a deck mounted thereto. Each deck having an upper deck skin and a lower deck skin which sandwiches a core. A drive system engaged with the first riser assembly and the second riser assembly telescopes the first riser assembly relative to the second riser assembly.

18 Claims, 14 Drawing Sheets

(56) References Cited

U.S. PATENT DOCUMENTS

| | | | | |
|---|---|---|---|---|
| 6,050,366 | A * | 4/2000 | Lyons | 187/200 |
| 6,085,861 | A | 7/2000 | Jines | |
| D432,669 | S | 10/2000 | Bryjak et al. | |
| 6,199,325 | B1 * | 3/2001 | Winship | 52/10 |
| 6,324,790 | B1 * | 12/2001 | Victor et al. | 52/9 |
| 6,539,672 | B1 * | 4/2003 | Frost | 52/9 |
| 6,571,915 | B1 | 6/2003 | de la Tour | |
| 6,598,351 | B2 * | 7/2003 | Hallberg | 52/9 |
| 6,615,548 | B1 * | 9/2003 | Nakamura et al. | 52/6 |
| 6,719,094 | B2 | 4/2004 | de la Tour | |
| 6,729,075 | B2 * | 5/2004 | Jines et al. | 52/7 |
| 6,922,947 | B2 | 8/2005 | Jines et al. | |
| 7,107,734 | B2 | 9/2006 | Jines et al. | |
| 2003/0009950 | A1 * | 1/2003 | Hallberg | 52/8 |
| 2003/0038065 | A1 * | 2/2003 | Pippin et al. | 209/584 |

* cited by examiner

POWERED TELESCOPIC SEATING RISER ASSEMBLY

The present disclosure is a continuation of U.S. patent application Ser. No. 11/542,753, filed Oct. 4, 2006 now U.S. Pat. No. 7,900,402.

BACKGROUND

The present invention relates to portable seating systems and more particularly to a powered telescopic seating riser assembly for a seating system with a multiple of seating configurations drivable between at least an extended position and a stored position.

Seating risers are designed for use in auditoriums, gymnasiums, and event halls to accommodate spectators on portable seats, such as folding chairs. Depending on the intended use, a facility may require seating risers that are capable of being moved from a retracted position for storage, to an extended position for use.

Heretofore, many conventional seating riser structures have been utilized for nonpermanent seating. These conventional systems generally utilize a series of assemblies having seating risers of given heights which store within close proximity to one another.

Because of the temporary nature of the seating used by some organizations and the large storage area required to house non-permanent seating systems when not extended for use, it is desirable to provide a variety of seating configurations with a single non-permanent seating system. With conventional non-permanent seating systems, several assemblies are placed adjacent one another, for instance, to form the seating along an athletic playing surface. Although modular in this sense, conventional non-permanent seating systems have a rise always constant with respect to the run.

Some conventional non-permanent seating systems are manually deployed. Although effective, significant manpower and time is typically required to deploy and store the system. Manual deployment and storage may be further complicated by the requirement that the non-permanent seating system needs to be deployed in a generally coordinated manner, otherwise, binding or other complications may result. Since the non-permanent seating system by its vary nature is a relatively large structure, coordination during manual deployment and storage coordination may be relatively difficult.

Other conventional non-permanent seating systems drive a wheel system thereof. Such drives require friction with a floor surface such that non-uniform traction may also result in the aforementioned binding.

SUMMARY OF THE INVENTION

An exemplary telescopic seating assembly includes a deck panel establishing a deck plane and a telescopic leg assembly attached to the deck panel. A toothed belt drive system is mounted to the telescopic leg assembly. The toothed belt drive system includes an electric motor that rotates a shaft about an axis to drive a toothed timing belt in a direction transverse the axis. The toothed timing belt is a continuous belt that engages a first and a second pulley mounted to a horizontal leg of the telescopic leg assembly.

An exemplary telescopic seating system includes a first deck panel and a second deck panel. A drive system selectively rotates a toothed belt. A belt clamp couples one of the first deck panel or the second deck panel to move with the toothed belt and to move relative to the other of the first deck panel or the second deck panel.

Another exemplary telescopic seating system includes a first riser mounted to a first leg assembly and having a first deck surface. A first belt is associated with the first leg assembly. A second riser is mounted to a second leg assembly. The second riser has a second deck surface at a different elevation than the first deck surface. A second belt is associated with the second leg assembly. The second belt is separate from the first belt. The first belt is driven to telescope the first riser relative to the second riser. The second belt is driven to telescope the second riser relative to a third riser.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION

Figure 1:
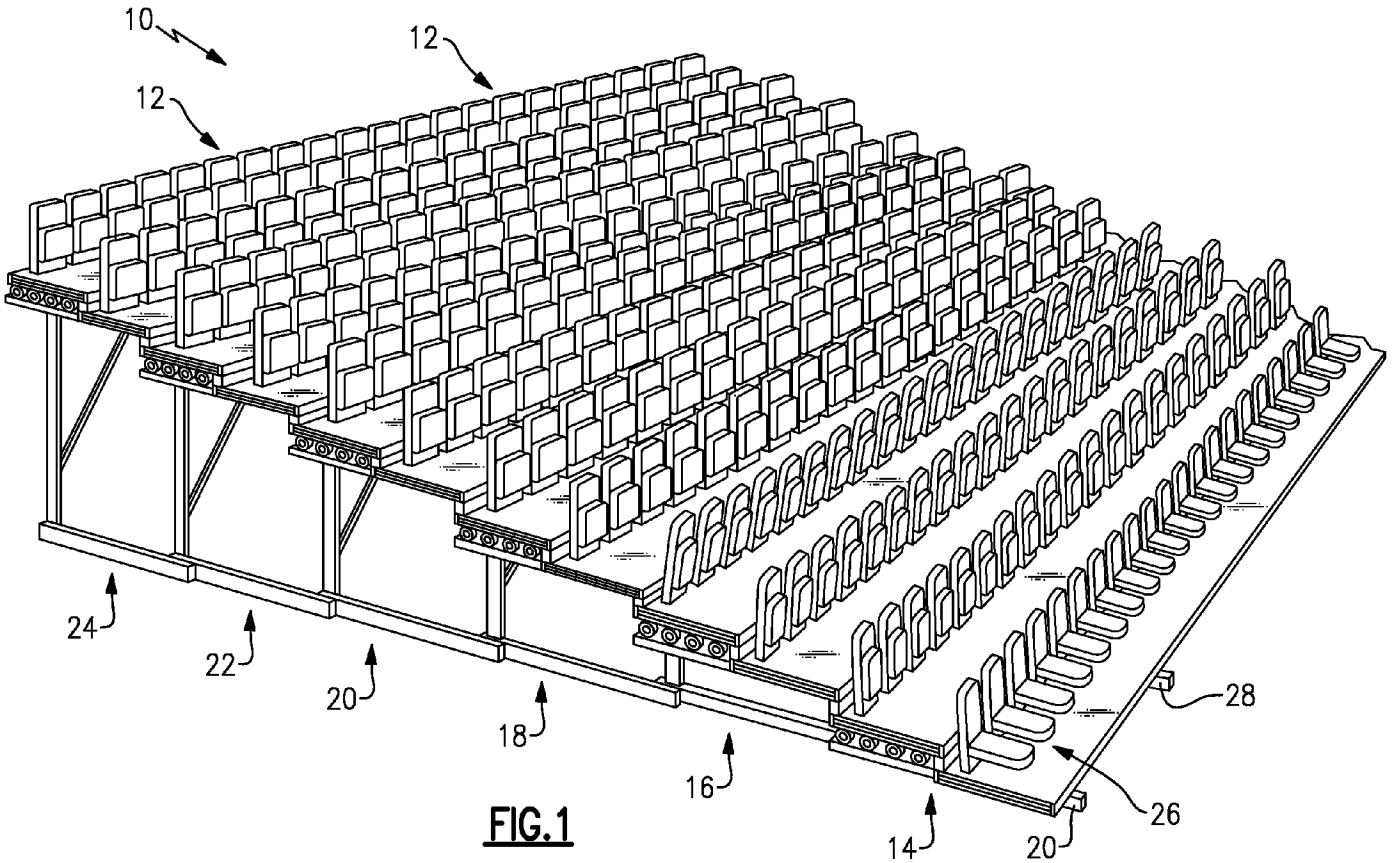
FIG. 1 is a perspective view of a non-permanent seating system in a deployed position.

FIG. 1 illustrates a general perspective view of a non-permanent seating system 10 having a multiple of telescopic seating riser systems 12. The telescoping seating riser system 12 forms the fundamental building blocks of the system 10. The system 12 may stand alone, or may stand side by side. It will be appreciated that the height thereof is dependent on design choices including the desired rise.

Each telescopic seating riser system 12 generally includes an innermost lower riser assembly 14, and successive outer elevated riser assemblies 16-24. It will be appreciated that the number of riser assemblies 14-24 in any given telescopic seating riser system 12 will be a matter of design requirements. Each riser assembly 14-24 generally includes a dual deck surface 26 and a pair of telescopic leg assemblies 28.

Figure 2A:
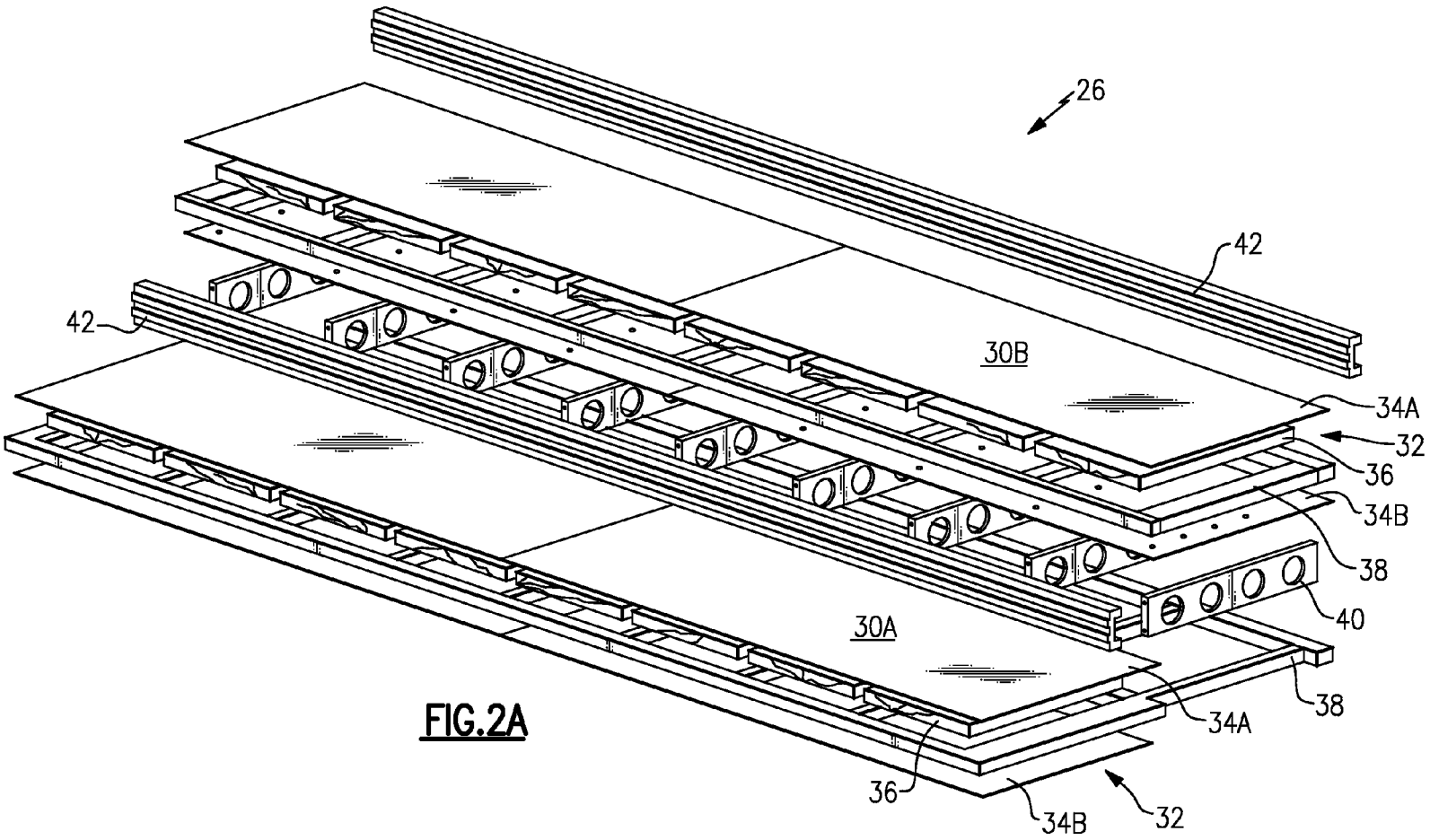
FIG. 2A is an exploded view of a dual deck surface.
Figure 2B:
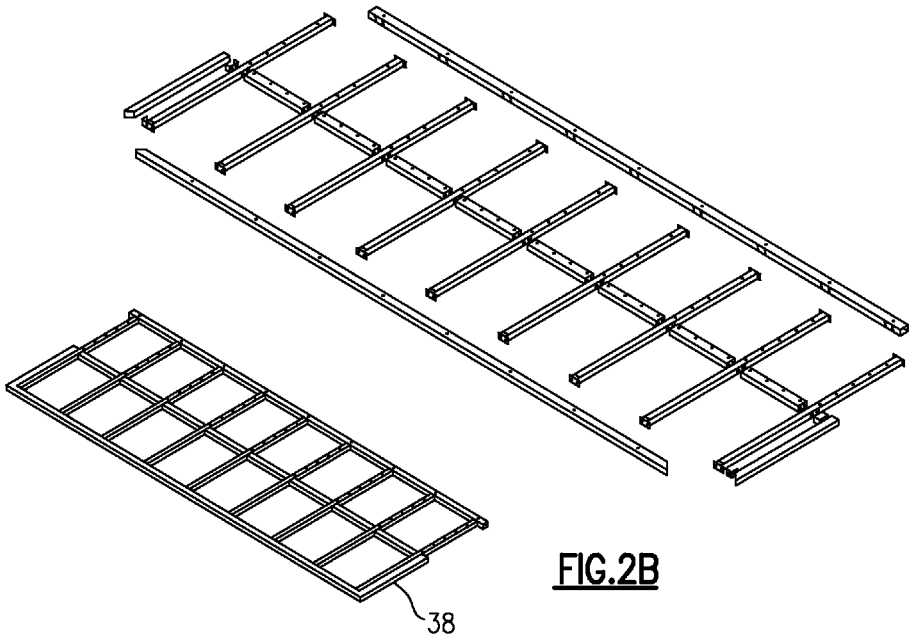
FIG. 2B is a perspective view of a frame of the dual deck surface of FIG. 2A.

Referring to FIG. 2A, the dual deck surface 26 includes a lower deck surface 30A and an upper deck surface 30B arranged in a stepped arrangement. The lower deck surface 30A and the upper deck surface 30B each establish a respective deck plane. The dual deck surface 26 generally utilizes a sandwich structure for each deck panel 32. The deck panel 32 is manufactured of an upper and lower deck skin 34A, 34B which sandwiches a core 36. The skins 34A, 34B are preferably manufactured of aluminum while the core 36 is formed of an end-grained balsawood or a honeycomb structure to provide a strong, lightweight and acoustically absorbent structure. The deck panels 32 are mounted to a framework 38 (FIG. 2B) which support a multiple of ribs 40 between a set of longitudinal access track beams 42 (also illustrated in FIG. 2C).

The multiple of ribs 40 provide the dual deck surface 26 by vertically separating the lower deck panel 32L from the upper deck panels 32U. Each riser assembly 14-24 includes one dual deck surface 26 with one lower deck panel 32L and one upper deck panel 32U to provide seating on two levels.

Figure 2C:
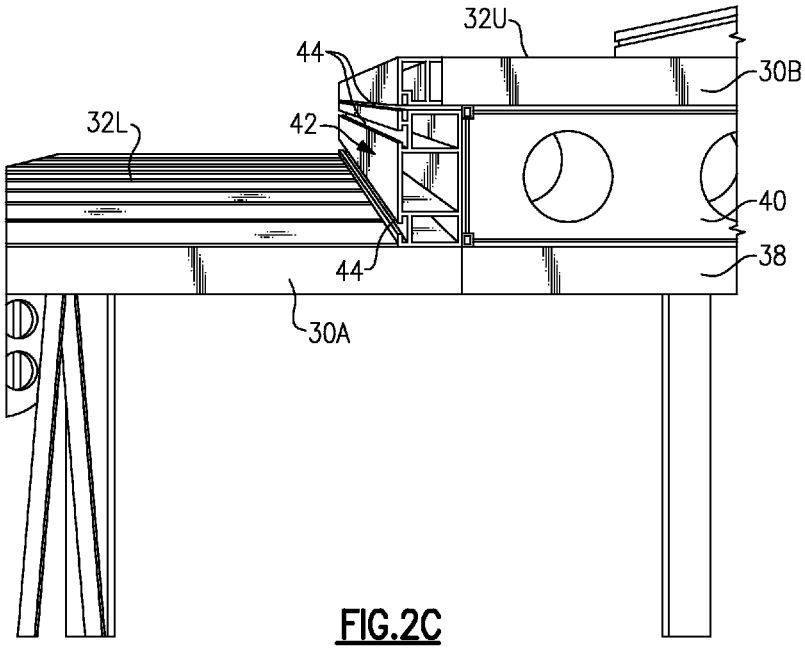
FIG. 2C is a sectional view through the dual deck surface illustrating an access track beam.

Referring to FIG. 2C, the longitudinal access track beams 42 include slots 44 which receive a chair beam mounting system S (FIG. 2D) such as that utilized in stadium seating systems such as that manufactured by Camatic Pty Ltd. of Wantirna, Australia. The access track beams 42 are arranged in a vertical relationship between each deck panel 32L, 32U to provide space for the seating system 10 when in a stored position. The slots 44 are longitudinally located within the access track beams 42 to provide communication passages for, for example only, aisle lighting, and attachment of, for example only, rails R (FIG. 2F), stair blocks B (FIG. 2F) and the aforementioned chair beam mounting system S.

Figure 3A:
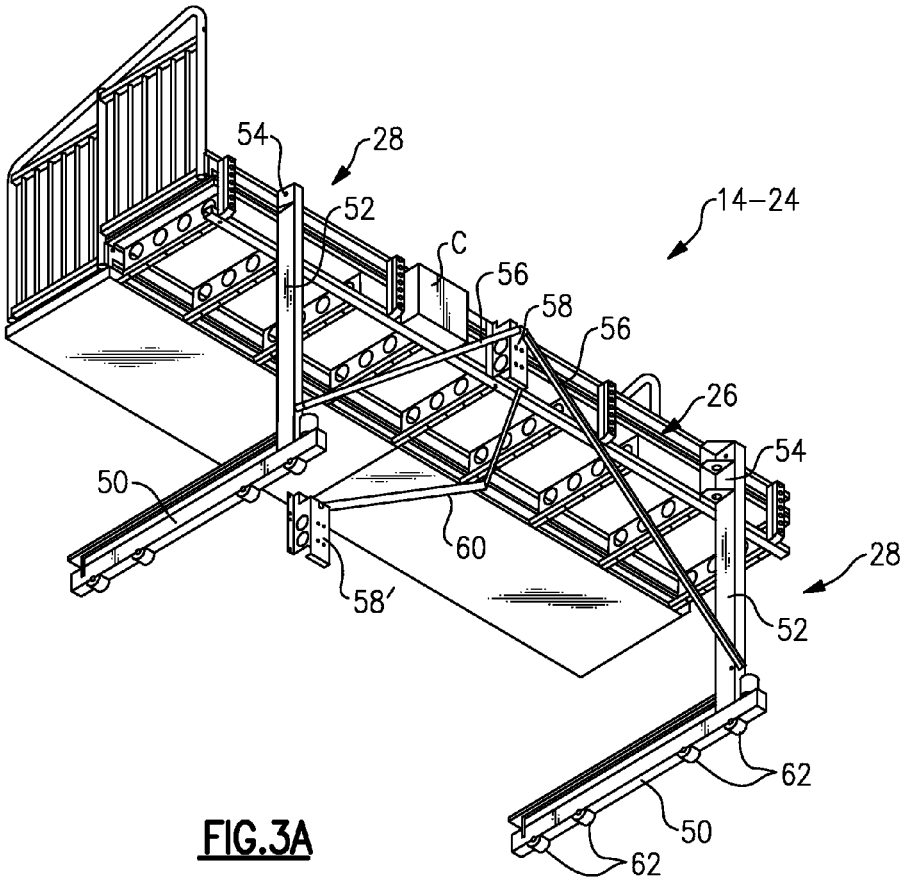
FIG. 3A is a perspective generally bottom view of a single riser assembly.

Referring to FIG. 3A, each telescopic leg assembly 28 includes a horizontal leg 50 and a vertical leg 52. It should be understood that although only a single leg assembly will be described, it should be understood that each leg assembly on each dual elevated riser assemblies 14-24 is generally alike. Notably, each riser assembly 14-24 telescopes under the next higher riser assembly 14-24.

Each vertical leg 52 is attached to the rear of the dual deck surface 26 through a bracket 54. The vertical leg 52 is preferably manufactured of square tubing, however, other shapes may likewise be usable with the present invention.

A set of rear cross members 56 are connected to the vertical leg 52 at their lower end and to the dual deck surface 26 at their upper end through a central bracket 58. The rear cross members 56 further stabilizes each riser assembly 14-24. The central bracket 58 is connected to another central bracket 58' on the next riser assembly 14-24 through an articulatable linkage 60 which articulates in response to telescopic movement of the riser assemblies 14-24. The linkage 60 preferably provides a passage for the communication of power cables, electronic control and the like.

The horizontal leg 50 is supported on wheels 62. Preferably, four wheels 62 are mounted within each of the horizontal legs 50 to allow each riser assemblies 14-24 to readily travel over a floor surface.

Figure 3B:
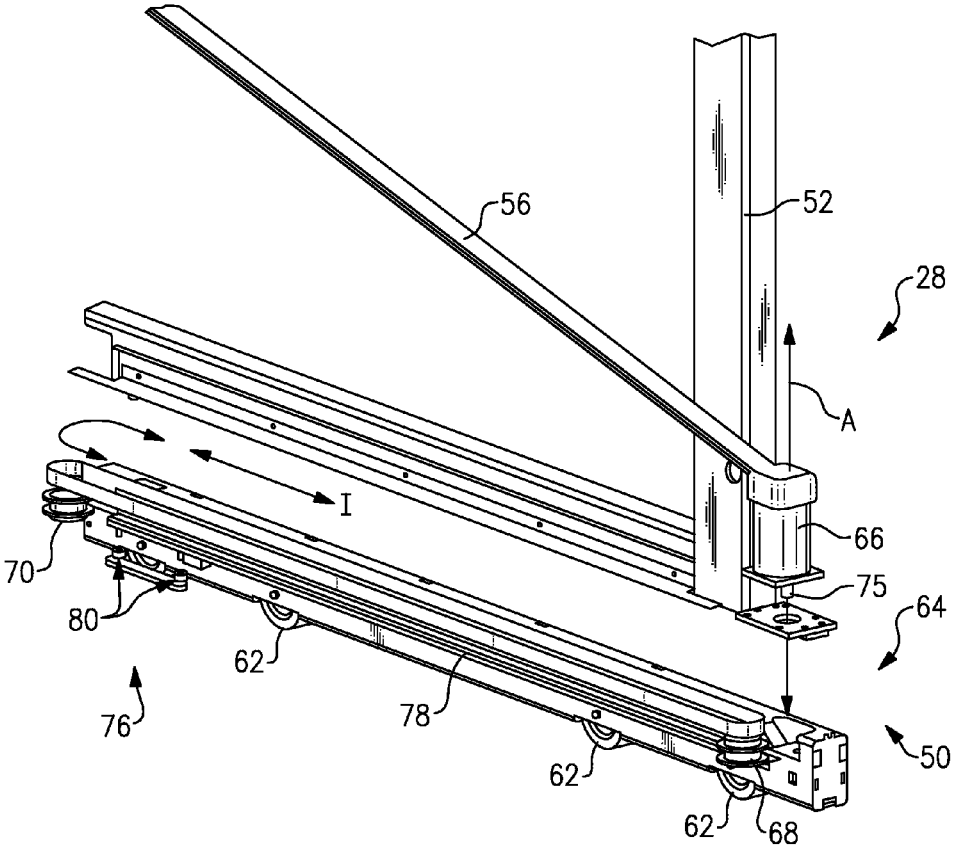
FIG. 3B is an expanded partially exploded view of a horizontal leg of the telescopic leg assembly of the riser assembly.
Figure 3C:
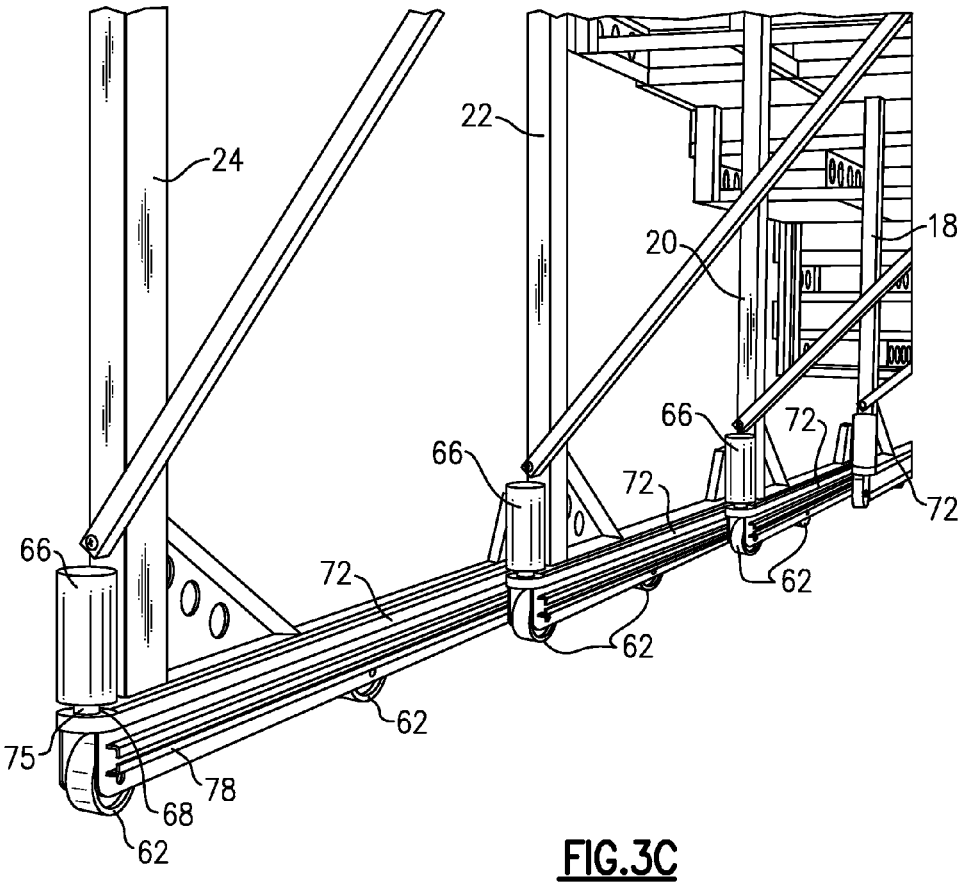
FIG. 3C is a perspective generally underside view of the non-permanent seating system in a deployed position illustrating a belt drive system and the interaction of a timing belt between each of the multiple of riser assemblies.

Referring to FIG. 3B, each horizontal leg 50 of each leg assembly 28 supports a toothed belt drive system 64. The belt drive system 64 includes an electric motor 66, an inner pulley 68, an outer pulley 70 and a toothed timing belt 72 therebetween. The toothed belt drive system 64 provides the interface between each adjacent riser assembly 14-24 (FIG. 3C) and the motive force to extend and retract the riser system 12 in a telescopic manner. The toothed timing belt 72 is continuous in this example. That is, the toothed timing belt 72 is a loop lacking a defined end.

The electric motor 66 is mounted directly aft of the vertical leg 52 in a readily accessible location. Notably, the power cable 67 from the electric motor 66 is preferably threaded through the associated rear cross members 56 to communicate with the central bracket 58 and a controller C preferably on the uppermost riser assembly 24.

Figure 3D:
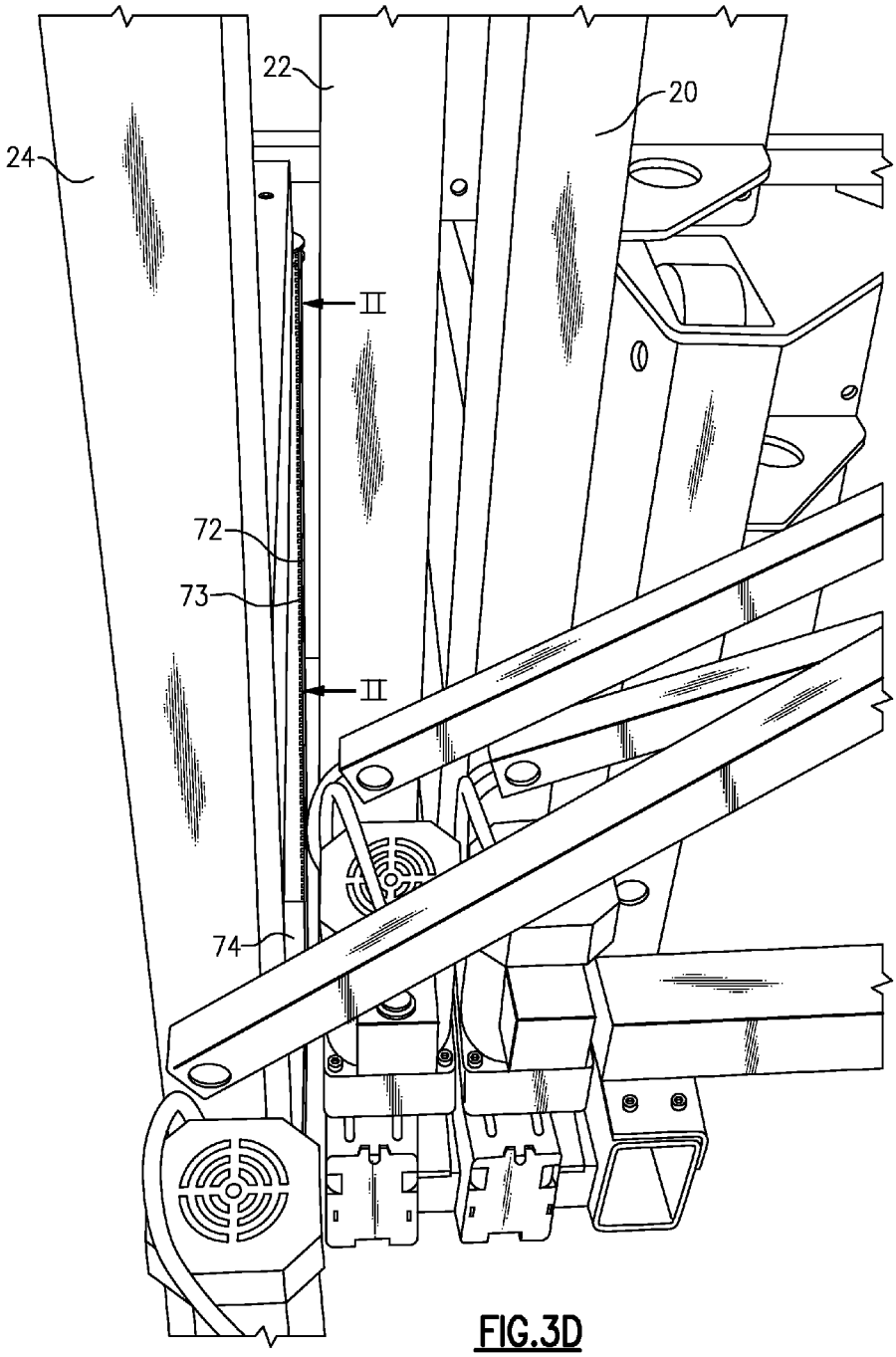
FIG. 3D is a perspective generally rear view of a multiple of the telescopic seat riser systems illustrating the tooth timing belt location.

The inner pulley 68 and the outer pulley 70 include a toothed surface to engage the toothed belt with a minimum of slippage. The example toothed surface includes a plurality of vertically extending teeth 73. The inner pulley 68 and the outer pulley 70 rotate about respective axes generally parallel to the vertical leg 52. The electric motor 66 includes a shaft 75 directly connected to the inner pulley 68. The shaft 75 rotates about an axis A that is perpendicular to the direction of movement I of the toothed timing belt 72. The direction of movement I establishes a belt plane associated with the toothed timing belt 72. The toothed timing belt 72 preferably faces away from, but is engaged with, each adjacent horizontal leg 50 of the next inner riser assembly 14-24 (FIG. 3D). That is, the toothed timing belt 72 of the belt drive system 64 on the horizontal leg 50 of the outermost riser assembly 24 faces inward toward its own horizontal leg in direction II. The belt 72, however, is engaged with the horizontal leg 50 of the next inner riser assembly 22 through a belt clamp 74 (FIG. 3H).

Figure 3E:
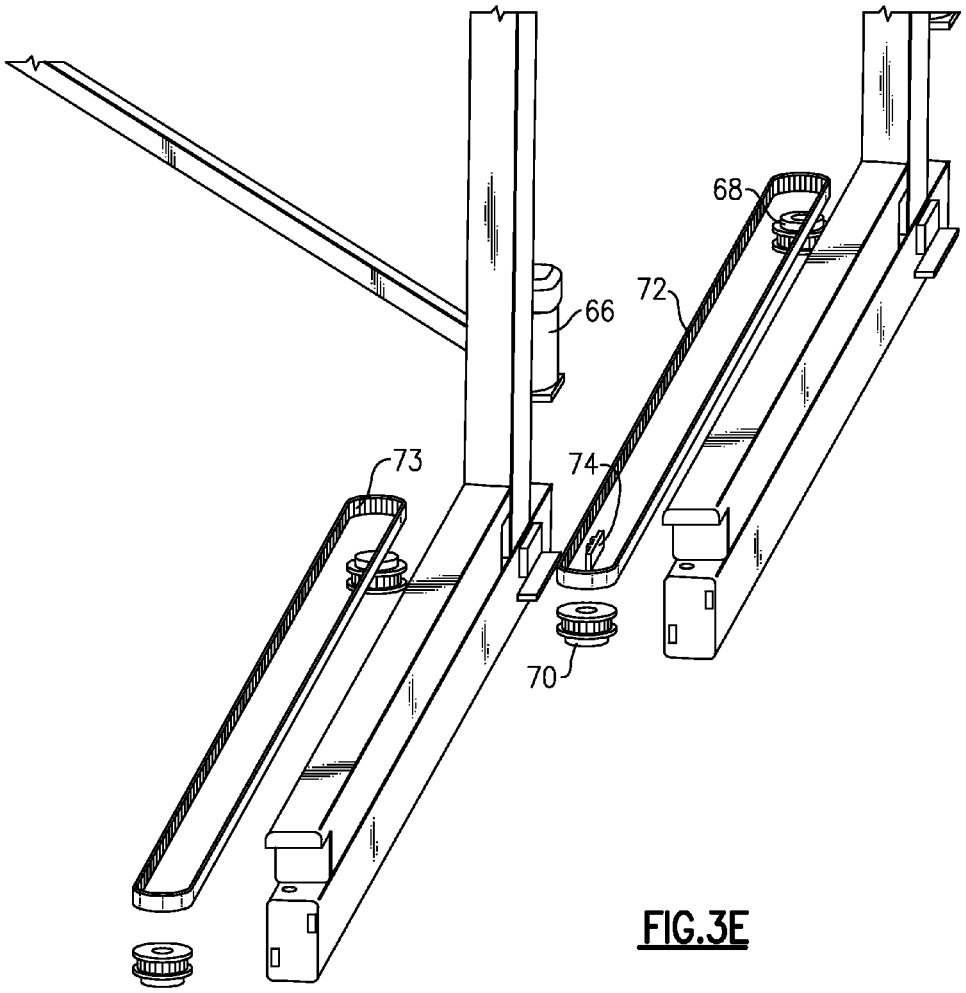
FIG. 3E is an exploded view of the tooth belt drive system.
Figure 3F:
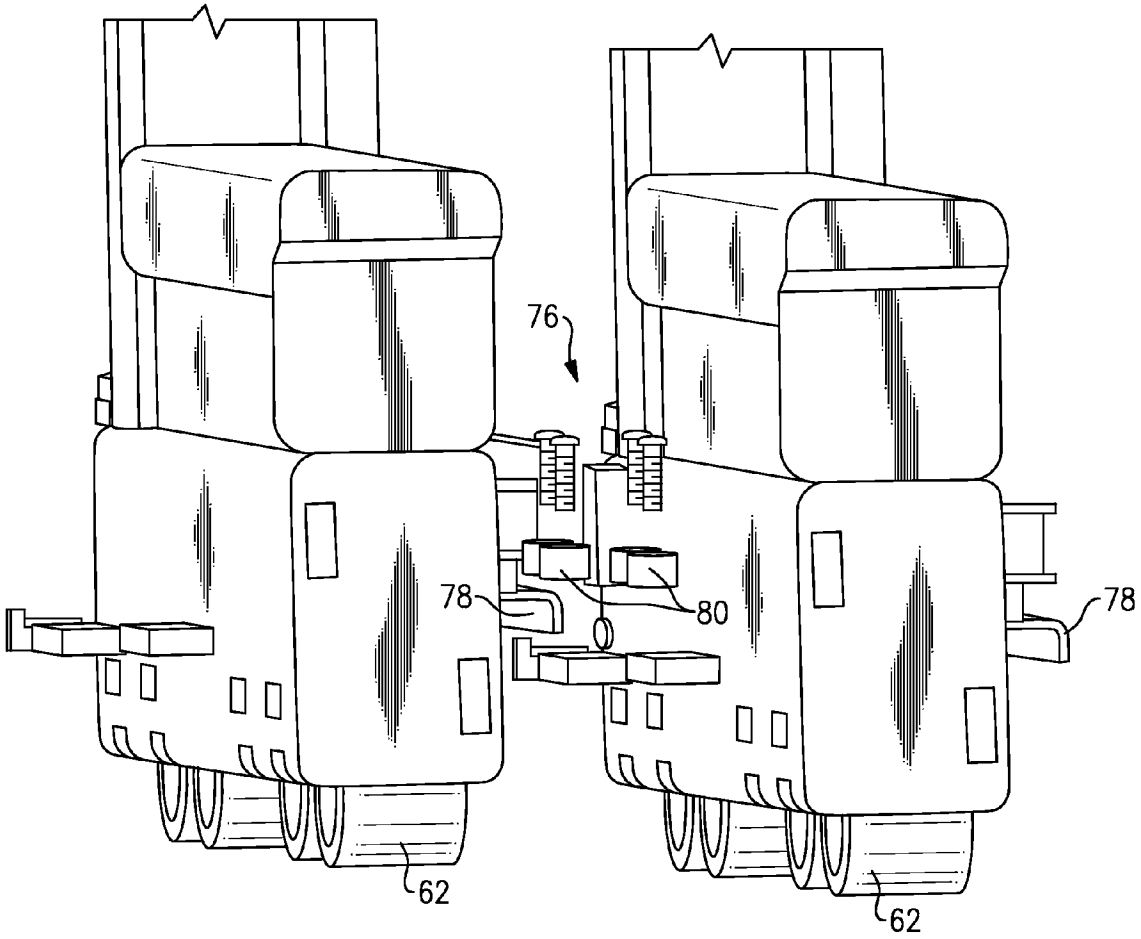
FIG. 3F is an exploded view of a guide roller assembly which movably links the riser assembly with the next adjacent riser assembly.

The toothed timing belt 72 engages the belt clamp 74 located on an outer surface of the adjacent next inner riser assembly 14-24 (FIG. 3E). Preferably, the belt clamp 74 is located adjacent the intersection of the horizontal leg 50 and the vertical leg 52 and includes a toothed surface which matches the toothed timing belt 72 for engagement therewith. The belt clamp 74 provides the engagement between the toothed timing belt 72 of the outer next inner riser assembly 14-24 with the next inner riser assembly 14-24 such that rotation of the toothed timing belt 72 drives the next inner riser assembly 14-24 relative the associated outer riser assembly 14-24.

Figure 3G:
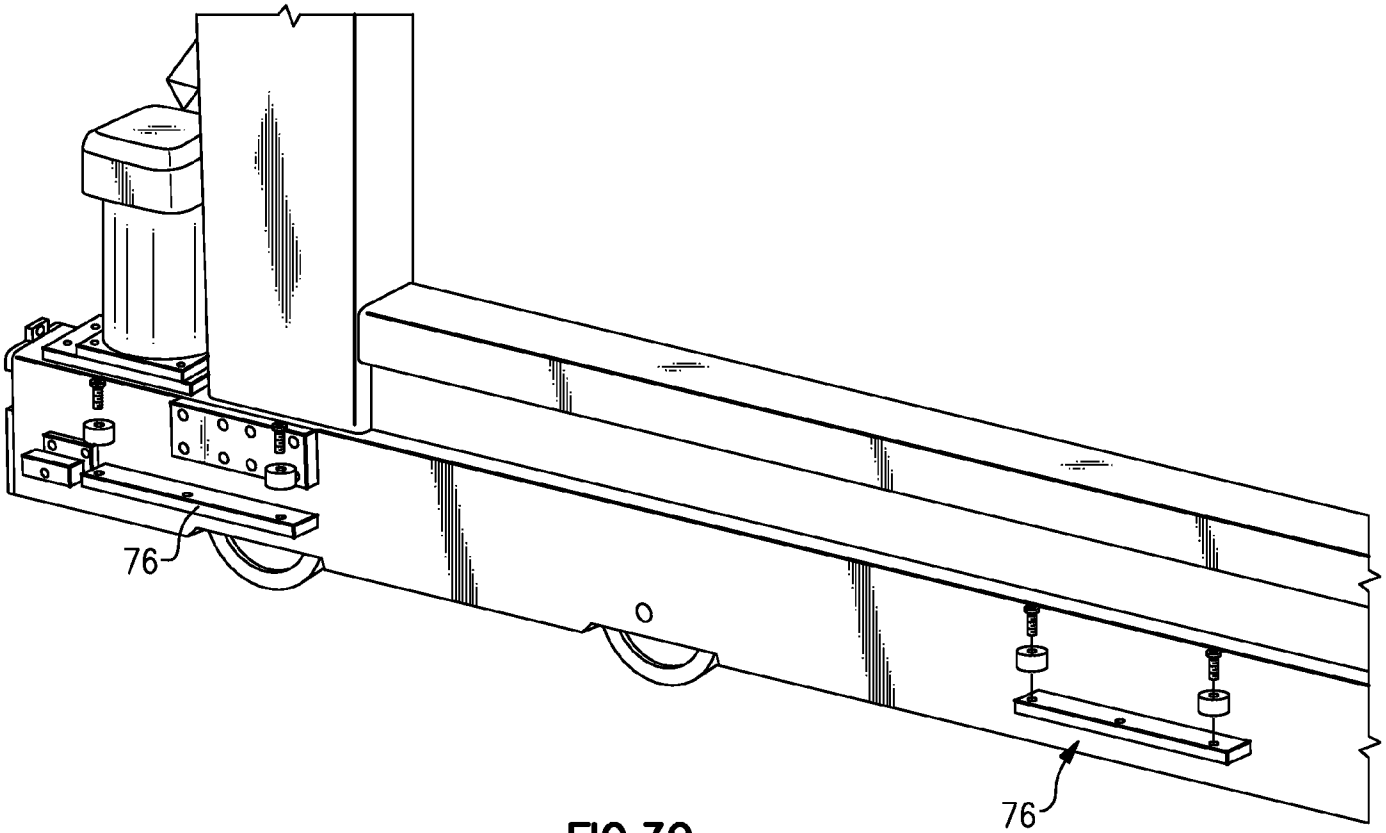
FIG. 3G is a perspective inner view of the locations of the guide assemblies for engagement with a track on an adjacent riser assembly.
Figures 3H, 4:
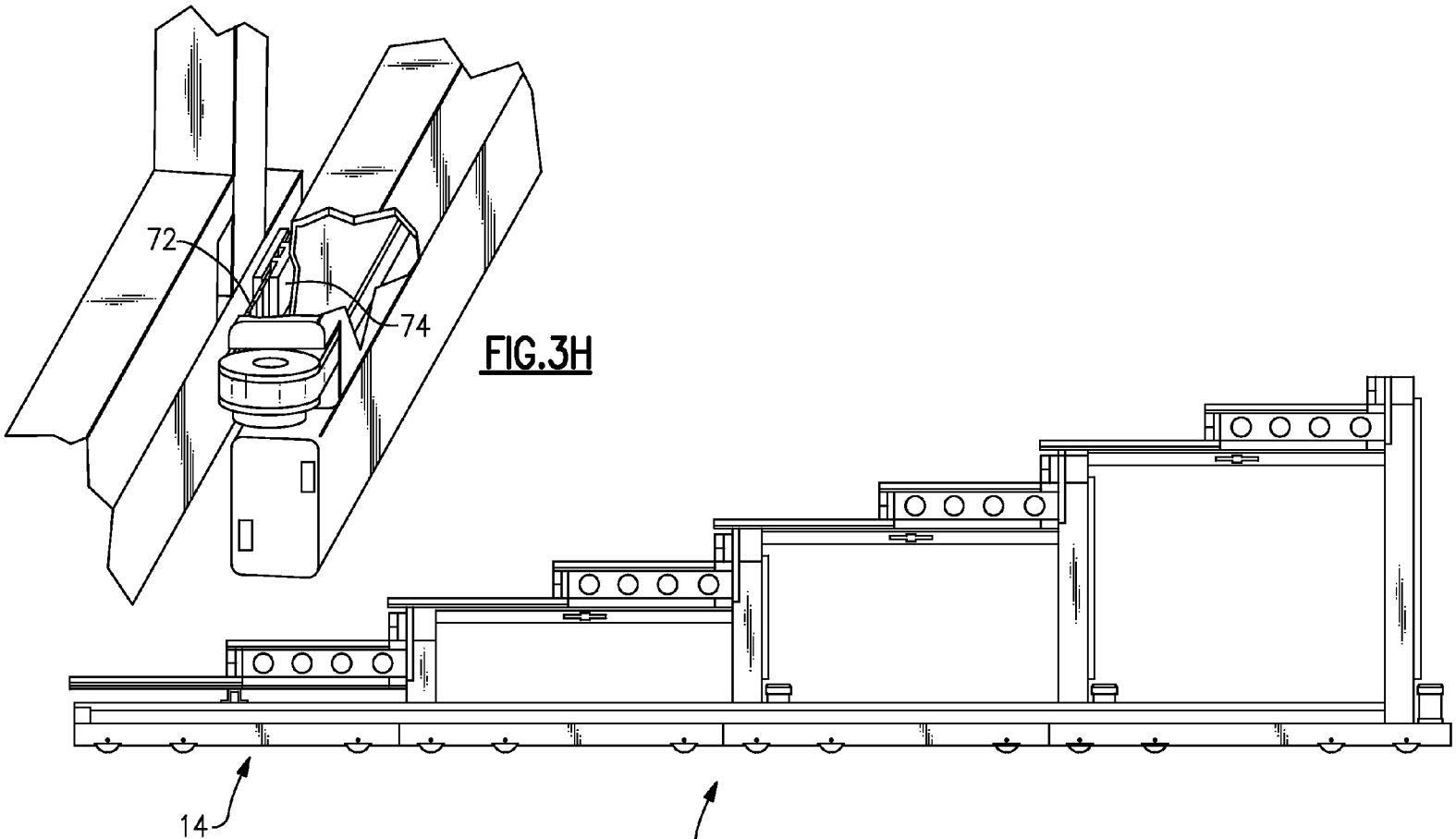
FIG. 3H is a view of the tooth belt drive system in an assembled position.
FIG. 4 is a side view of a section of a non-permanent seating system in a fully deployed position.

Referring to FIG. 3B, a guide assembly 76 along the length of the horizontal leg 50 further guides the inner riser assembly 14-24 relative the associated outer riser assembly 14-24. Preferably, a track 78 and guider roller assembly 80 (FIG. 3G) provides an effective low friction interface between one inner riser assembly 14-24 and the next associated outer riser assembly 14-24. It should be understood that various guide assemblies 76 may be utilized with the present invention.

Figure 2D:
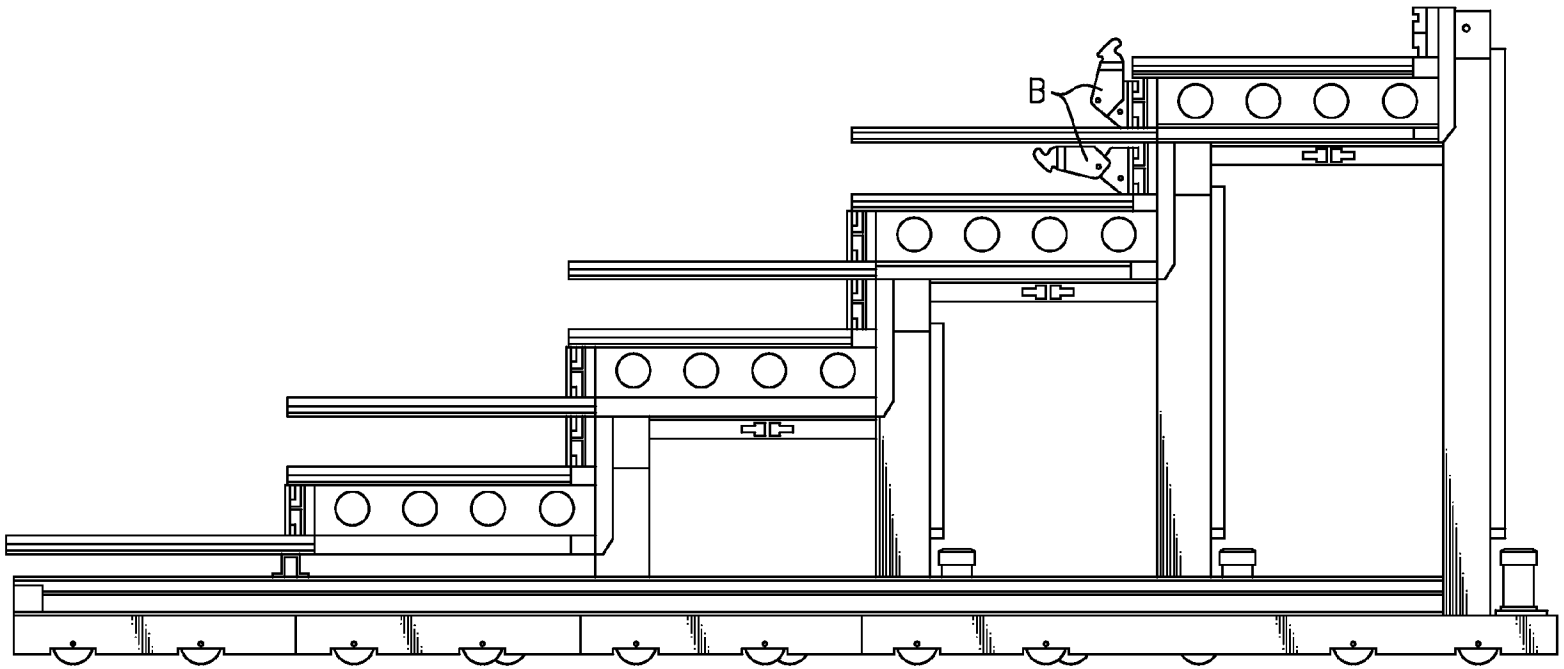
FIG. 2D is a side view of a section of a non-permanent seating system in a half-deployed position in which only half the seating capacity of each riser assembly is utilized but each seating row provides twice the rise.
Figure 2E:
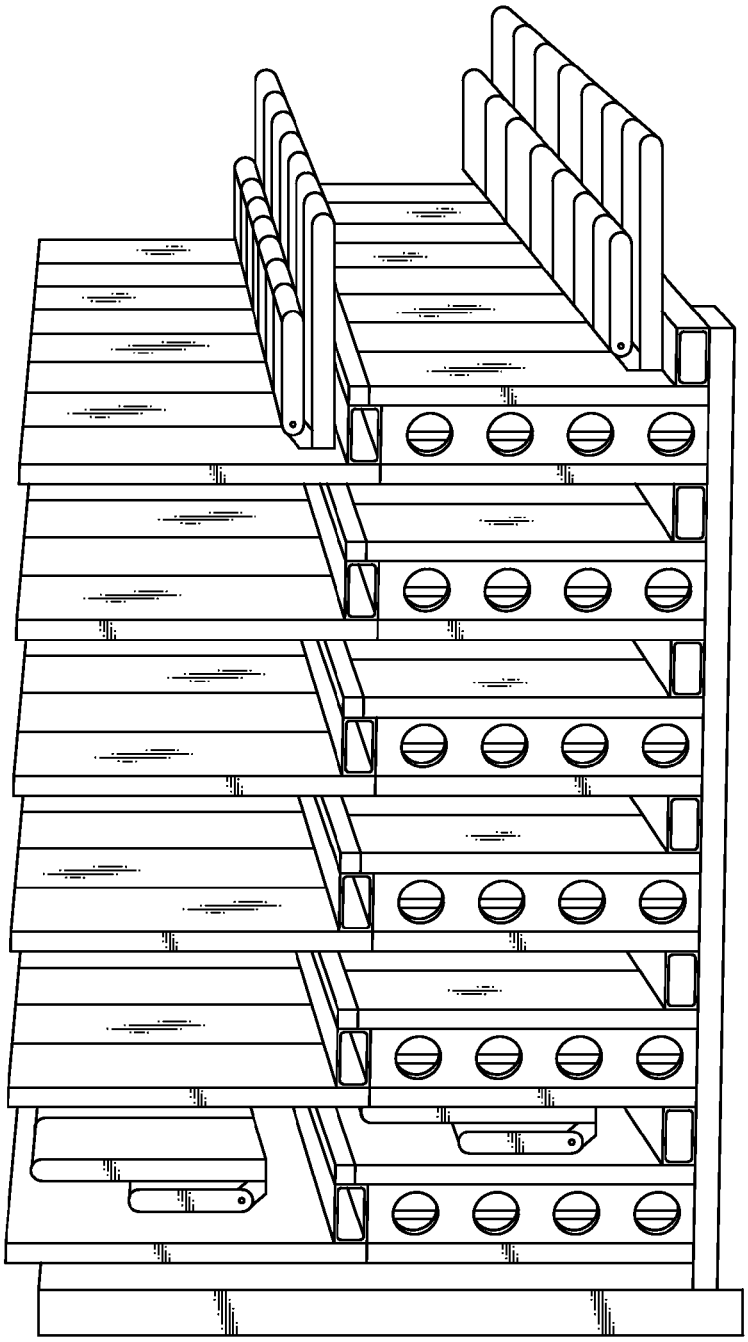
FIG. 2E is a perspective view of the non-permanent seating system in a stored position.
Figures 1, 2F:
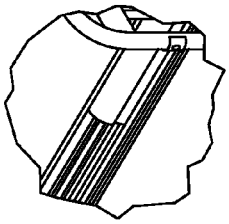
FIG. 2F is a perspective view of the non-permanent seating system illustrating one arrangement of rails and stair blocks therefore.
Figures 2, 2F:
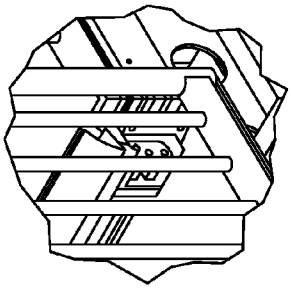
Figure 2F:
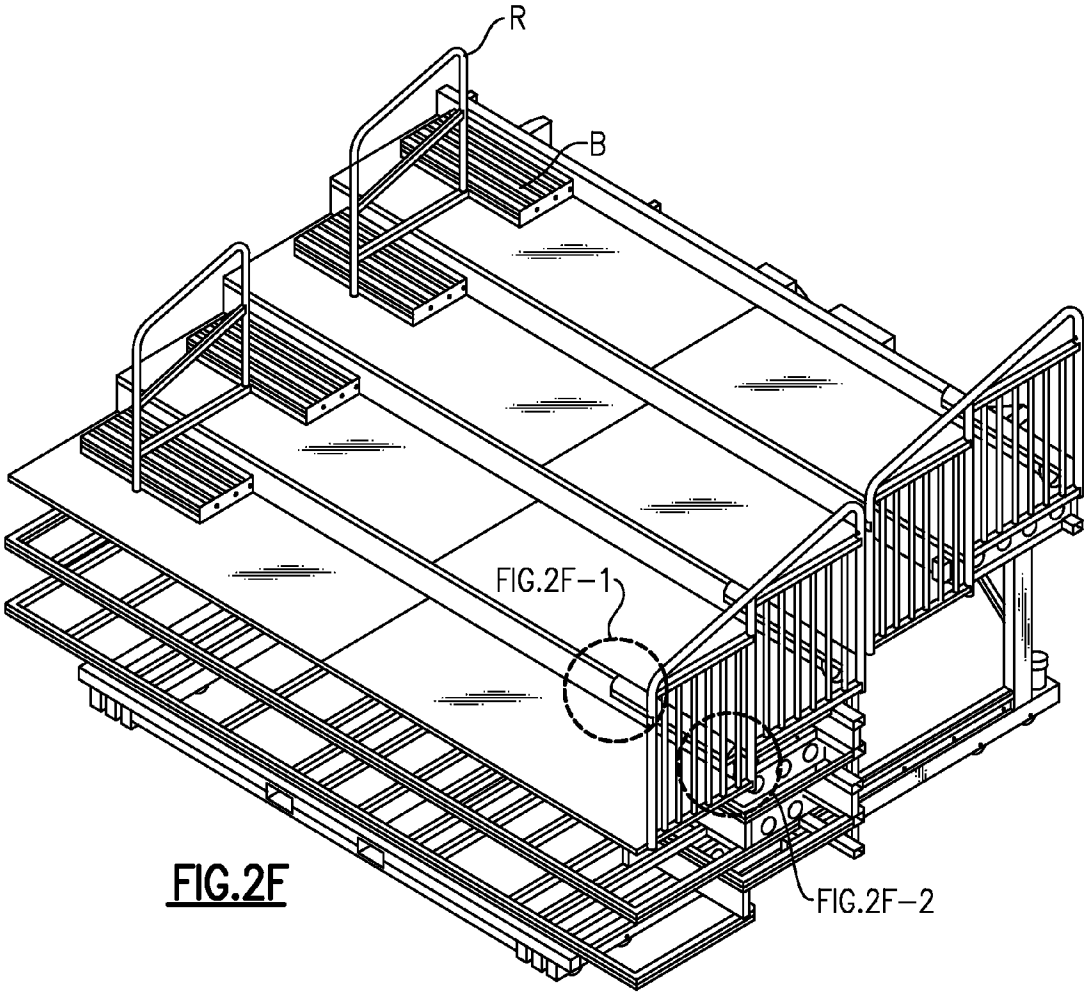

In operation, the pair of each electric motors 66 on each riser assembly 14-24 are driven simultaneously by the controller C to fully extend the seating riser system 12 from the storage position (FIG. 2E). The controller C provides for programmed stops of each riser assembly 14-24 such that the telescopic seating system 10 may be readily deployed to the fully extended position (FIGS. 1 and 4) or to the half-deployed position (FIG. 2D). The half-deployed position utilizes only half the seating capacity of each riser assembly 14-24 but provides twice the rise between each seating row to thereby accommodate particular venues. The controller C also communicates with each motor 66 such that the telescopic seating system 10 can be assured of straight tracking through torque sensing. Furthermore, the belt drive system 64 assures coordinated deployment as the toothed timing belt 72 minimizes the likelihood of slippage.

It will be appreciated that seating system is a load bearing structure intended to hold many people and equipment, such as portable seating, above a floor surface. Therefore, the telescopic seating system is suitably constructed. For instance, the structural members of the telescopic seating system preferably are constructed of thin wall tubing, straight bar stock, right angle bar stock, and plate of suitable materials, for instance, steel, alloy, aluminum, wood or high strength plastics. Components may be joined in any number of conventional manners, such as by welding, gluing or with suitable fasteners. Wheels are preferably of the solid caster type. It will be appreciated that in reference to the wheels, such wheels may be constructed of any device that provides rolling or other relative movement, such as sliding, between respective track surfaces.

It should be understood that relative positional terms such as "forward," "aft," "upper," "lower," "above," "below," and the like are with reference to the normal operational attitude of the system and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A telescopic seating assembly comprising:

a deck panel establishing a deck plane;

a telescopic leg assembly attached to the deck panel; and a belt drive system mounted to the telescopic leg assembly and including an electric motor that rotates a shaft about an axis to drive a belt in a direction transverse the axis, wherein the belt is a continuous belt that engages a first and a second pulley mounted to a horizontal leg of the telescopic leg assembly.

2. The assembly of claim 1, wherein the deck panel comprises an upper deck skin, a lower deck skin, and a core sandwiched therebetween.

3. The assembly of claim 2, wherein the deck panel includes an access track beam extending from the lower deck skin to the upper deck skin.

4. The assembly of claim 3 including longitudinal slots located within the access track beam.

5. The assembly of claim 1, wherein the belt comprises a toothed belt.

6. The assembly of claim 1, wherein the belt drive system comprise a toothed timing belt that rotates in a first plane, and the telescopic leg assembly telescopes in a first direction parallel to the first plane.

7. The assembly of claim 1, wherein the electric motor is secured directly to a vertically extending leg of the telescopic leg assembly.

8. The assembly of claim 1, wherein the electric motor is mounted to the telescopic leg assembly such that the entire electric motor moves together with the telescopic leg assembly as the telescopic leg assembly is telescoped.

9. A telescopic seating system comprising:

a first riser mounted to a first leg assembly and having a first deck surface;

a first belt associated with the first leg assembly;

a second riser mounted to a second leg assembly, the second riser having a second deck surface at a different elevation than the first deck surface; and a second belt associated with the second leg assembly, the second belt configured to be driven separately from the first belt, wherein the first belt is driven to telescope the first riser relative to the second riser, and the second belt is driven to telescope the second riser relative to a third riser, wherein the first belt is configured to telescope the first riser relative to the second riser independently of the second belt, and the second belt is configured to telescope the second riser relative to the third riser independently of the first belt.

10. The telescopic seating system of claim 9, wherein the first riser has dual deck surfaces.

11. The telescopic seating system of claim 9, wherein the first belt is rotatable separately from the second belt.

12. A telescopic seating system comprising:

a first deck panel;

a second deck panel;

a drive system that selectively rotates a belt; and a belt clamp that couples the at least one of the first deck panel or a support structure of the first deck panel to the belt such that the first deck panel moves with the belt relative to the second deck panel.

13. The system of claim 12, wherein the drive system rotates the belt to telescope the first and second deck panels relative to each other.

14. The system of claim 12, wherein the support structure is a horizontal leg of an inner riser assembly and the belt clamp is located on an outer surface of the horizontal leg, the belt clamp configured to directly engage with the belt and the outer surface.

15. The system of claim 12, wherein the belt is a continuous toothed belt.

16. The system of claim 12, including a second belt clamp member that couples the second deck panel or a support structure of the second deck panel to a second belt relative to a third deck panel.

17. The assembly as recited in claim 12, wherein the belt rotates within a plane that is parallel to a direction that the first and second deck panels move relative to each other.

18. The system as recited in claim 12, wherein a motor of the drive system is configured to move together with the first deck panel.

* * * * *